US011891745B2

(12) United States Patent
Zhao et al.

(10) Patent No.: US 11,891,745 B2
(45) Date of Patent: Feb. 6, 2024

(54) WASHING APPLIANCE AND DETERMINATION METHOD FOR LOCKING A DRUM OF WASHING APPLIANCE

(71) Applicants: Qingdao Haier Laundry Electric Appliances Co., Ltd., Qingdao (CN); HAIER SMART HOME CO., LTD., Qingdao (CN)

(72) Inventors: Zhiqiang Zhao, Qingdao (CN); Sheng Xu, Qingdao (CN)

(73) Assignees: QINGDAO HAIER LAUNDRY ELECTRIC APPLIANCES CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 0 days.

(21) Appl. No.: 17/636,058

(22) PCT Filed: Aug. 19, 2020

(86) PCT No.: PCT/CN2020/109903
§ 371 (c)(1),
(2) Date: Feb. 17, 2022

(87) PCT Pub. No.: WO2021/032101
PCT Pub. Date: Feb. 25, 2021

(65) Prior Publication Data

US 2022/0282419 A1 Sep. 8, 2022

(30) Foreign Application Priority Data

Aug. 20, 2019 (CN) ..... 201910769300.9

(51) Int. Cl.
*D06F 37/30* (2020.01)
*D06F 37/04* (2006.01)
(Continued)

(52) U.S. Cl.
CPC ..... *D06F 37/302* (2013.01); *D06F 37/04* (2013.01); *D06F 37/42* (2013.01); *D06F 2103/46* (2020.02); *D06F 2105/46* (2020.02)

(58) Field of Classification Search
CPC ..... D06F 37/04; D06F 37/302; D06F 37/42; D06F 2103/46; D06F 2105/46
See application file for complete search history.

(56) References Cited

U.S. PATENT DOCUMENTS

2003/0172688 A1* 9/2003 Fukui ..... D06F 37/302 68/12.02
2019/0017210 A1 1/2019 Han et al.
2019/0145040 A1* 5/2019 Lv ..... D06F 37/267 68/212

FOREIGN PATENT DOCUMENTS

CA 2043683 1/1999
CN 02160752.4 7/2004
(Continued)

OTHER PUBLICATIONS

Electronic translation of EP-0604261-B1. (Year: 1997).*

*Primary Examiner* — Joseph L. Perrin
(74) *Attorney, Agent, or Firm* — Sand, Sebolt & Wernow Co., LPA

(57) ABSTRACT

Washing appliance and a determination method for locking of a drum thereof. The washing appliance includes a drum for containing washing water, a drum motor for driving the drum to rotate and a locking structure for locking the drum. The drum motor drives the drum to rotate at a set power output, the locking structure generates a locking action for locking the drum, and until an output current of the drum motor is larger than a rated current, it is determined that the drum is locked by the locking structure; by comparing the output current of the drum motor with the rated current, until the output current of the drum motor is larger than the rated
(Continued)

current. Whether the drum is locked by the locking structure or not can be accurately determined through the above determination, and therefore the drum locking accuracy can be improved.

10 Claims, 3 Drawing Sheets

(51) Int. Cl.

| | |
|---|---|
| ***D06F 37/42*** | (2006.01) |
| ***D06F 105/46*** | (2020.01) |
| ***D06F 103/46*** | (2020.01) |

(56) References Cited

FOREIGN PATENT DOCUMENTS

| | | | |
|---|---|---|---|
| CN | 1572957 | | 2/2005 |
| CN | 1626720 | | 6/2005 |
| CN | 03105194.4 | | 3/2006 |
| CN | 101044277 | | 9/2007 |
| CN | 101729012 | | 6/2010 |
| CN | 106480647 | | 3/2017 |
| CN | 107022882 | | 8/2017 |
| CN | 109402940 | | 3/2019 |
| CN | 109518418 | | 3/2019 |
| CN | 109563672 | A | 4/2019 |
| EP | 0604261 | A1 | 6/1994 |
| EP | 0604261 | B1 * | 1/1997 |
| JP | 2003251095 | | 9/2003 |
| JP | 2005143808 | A | 6/2005 |
| JP | 2012090831 | A | 5/2012 |
| JP | 2017055579 | A | 3/2017 |

* cited by examiner

WASHING APPLIANCE AND DETERMINATION METHOD FOR LOCKING A DRUM OF WASHING APPLIANCE

TECHNICAL FIELD

The present disclosure belongs to the field of household appliances, and particularly relates to washing appliance and a determination method for locking of a drum of washing appliance.

BACKGROUND

At present, commonly used drum washing machines are side-opening-door type washing machines. When the side-opening-door type washing machines are used, a user needs to bend down or squat down to put laundry into a drum from a side door of the washing machine or take out the laundry in the drum, and the use feeling of the user (especially for the old) is affected.

Therefore, a top-opening-door type drum washing machine is provided for application. A drum door is also arranged in the circumferential direction of the drum corresponding to a top opening door of the washing machine. When the drum door rotates to a position corresponding to the top opening door, the drum is locked. The Chinese patent application No. CN02160752.4 discloses a method for automatically positioning a drum washing machine and a device thereof. The method includes: determining the position of the drum door of the washing machine through a position determination device when a drum of a washing machine stops rotating after an original washing program is finished or interrupted, and keeping a motor for driving the drum to rotate in a stopped state when it is determined that the drum door is at a normal opening position; and staring the motor to run at a low speed until the position determination device determines that the drum door is at the normal opening position when it is determined that the drum door is not be at the normal opening position, and enabling the motor to stop rotating. According to the method for automatically positioning a drum washing machine and a device thereof, the drum door of the drum washing machine can be automatically positioned at the normal opening position after automatic washing is finished, and the washing machine is more user-friendly and convenient to use. Chinese patent application No. CN03105194.4 discloses a drum washing machine in which the rotational position of a drum is fixed with a simple structure. An engaging groove part is provided at the outer circumferential edge of a rotor of an external gear type motor which is directly connected with a main shaft of a drum, and a drum locking device is arranged right below the shaft. The drum locking device has a structure in which a locking pin moves up and down along with the rotation of a torque motor, and the locking pin advances to be embedded into a slotted hole of the engaging groove part so as to lock the drum at the locking position. However, in the automatic positioning method and device for the drum door of the drum washing machine and the drum type washing machine, it is disclosed that when the drum reaches a normal opening position of a drum door, and whether the drum is successfully locked or not is not determined in a locking position, resulting in the influence of the accuracy of drum locking.

In view of this, the present disclosure is specifically provided.

SUMMARY

The technical problem to be solved by the present disclosure is to overcome the defect of low drum locking accuracy in the prior art and provide washing appliance.

In order to solve the above technical problem, the technical solution adopted by the present disclosure is as follows.

In one aspect of the present disclosure, a determination method for locking of a drum of washing appliance which is provided with a drum motor for driving a drum to rotate and a locking structure, comprises, the drum motor driving the drum to rotate at a set power output, the locking structure taking a locking action for locking the drum, and being determined that the drum is locked by the locking structure when an output current of the drum motor is greater than a rated current.

In one embodiment, the locking structure takes the locking action for locking the drum, and the drum motor drives the drum to continuously rotate at the set power output. After the drum rotates for a certain time t, the output current of the drum motor is detected to obtain the output current $I_1$ of the drum motor.

If $I_1>I_0$, the drum is locked by the locking structure; and if $I_1<I_0$, the locking structure fails to lock the drum.

In one embodiment, the locking structure includes a bolt, and a locking motor for driving the bolt to stretch out and draw back in a radial direction, and a rotor of the drum motor is provided with a locking groove.

After the drum rotates for a certain time t, the bolt of the locking structure is aligned with a position of the locking groove, the locking motor drives the bolt to be inserted into the locking groove, and the drum is locked by the locking structure.

Preferably, after the bolt is inserted into the locking groove to lock the drum, the drum motor is powered off to stop working.

In one embodiment, after the locking structure fails to lock the drum, the locking motor drives the bolt to be detached from the drum motor, the bolt is reset, the drum motor drives the drum to continuously rotate at a set power output, and it is determined whether the drum is locked by the locking structure again.

In one embodiment, S1, driving the drum to rotate by the drum motor at a set power output, generating a locking action for locking the drum by the locking structure, driving the drum to continuously rotate by the drum motor at the set power output, and detecting an output current of the drum motor to obtain an output current value $I_1$ of the drum motor after the drum rotates for a certain time t;

S2, comparing the output current value $I_1$ of the drum motor with a rated current value, and if $I_1>I_0$, executing a step S3; and if $I_1<I_0$, executing a step S5;

S3, if it is determined that the bolt is driven to be inserted into the locking groove by the locking motor and the drum is locked by the locking structure, executing a step S4;

S4, allowing the drum motor to be powered off to stop working; and

S5, driving the bolt to be detached from the drum motor by the locking motor, resetting the bolt, driving the drum to continuously rotate at the set power output by the drum motor, and executing the step S1 again.

In one embodiment the drum motor receives a stop command, a power of the drum motor is reduced to a set power, and the drum motor drives the drum to rotate at the set power output.

In one embodiment, after the locking structure fails to lock the drum and if it is detected that the number of times that the locking structure fails to lock the drum exceeds a set number of times, the locking structure stops locking, and the washing appliance sends out an alarm signal.

Another object of the present disclosure is to provide washing appliance for improving the accuracy of locking the drum. In order to achieve the purpose, the washing appliance is provided. The washing appliance includes a drum for containing washing water and a drum motor for driving the drum to rotate. The washing appliance is applied to the determination method for locking of the drum of the washing appliance provided by the above technical solution, and the washing appliance is provided with a locking structure for locking the drum.

In one embodiment, the drum is a closed container for containing washing water when the washing appliance executes a washing program.

In one embodiment, the drum is rotatably mounted in an outer barrel of the washing appliance, and the locking structure is mounted on an outer barrel bottom. The locking structure includes a bolt, and a locking motor for driving the bolt to stretch out and draw back in a radial direction. A rotor of the drum motor is provided with a locking groove matched with the bolt, and the bolt is driven to be inserted into or detached from the locking groove by the locking motor.

After the above technical solution is adopted, compared with the prior art, the present disclosure has the following beneficial effects.

1. According to the determination method for locking of the drum of the washing appliance provided by the present disclosure, the washing appliance is provided with the drum motor for driving the drum to rotate, and the locking structure. The drum motor drives the drum to rotate at the set power output, the locking structure takes the locking action for locking the drum, and it is determined that the drum is locked by the locking structure when the output current of the drum motor is greater than the rated current. Through the above determination, the accuracy of locking the drum can be improved.

2. According to the determination method for locking of the drum of the washing appliance provided by the present disclosure, if the output current $I_1$ of the drum motor is greater than the rated current $I_0$, the drum is locked by the locking structure; and if $I_1<I_0$, the locking structure fails to lock the drum.

3. The drum of the washing appliance provided by the present disclosure is the closed container for containing washing water when the washing appliance executes the washing program, the drum is rotatably mounted in the outer barrel of the washing appliance, and the locking structure is mounted on the outer barrel.

The embodiments of the present disclosure are described in further detail below with reference to the accompanying drawings.

BRIEF DESCRIPTION OF THE DRAWINGS

The drawings as one part of the present disclosure are intended to provide a further understanding for the present disclosure. Schematic embodiments and illustrations of the present disclosure are intended to explain the present disclosure, rather than an improper limitation of the present disclosure. Obviously, the drawings in the following description are only some embodiments. For those of ordinary skill in the art, other drawings can be obtained based on these drawings without inventive efforts. In the drawings.

Figure 1:
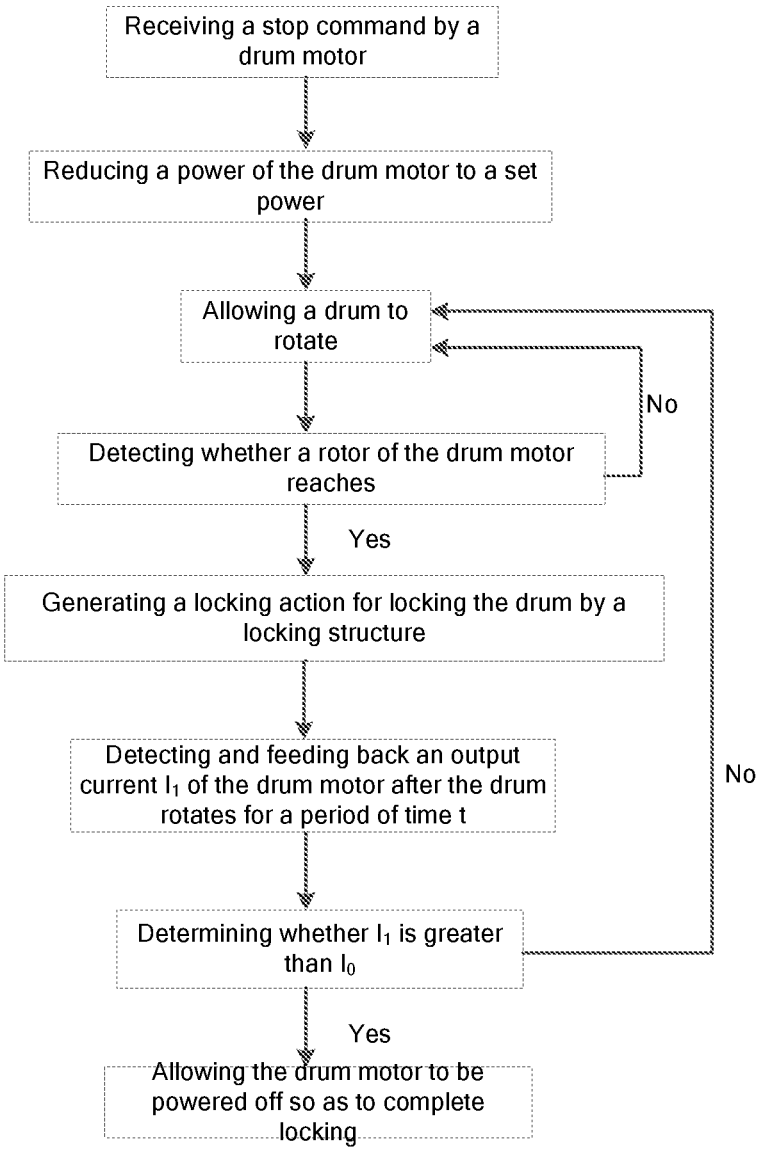
FIG. 1 is a flow diagram of a determination method for locking of a drum of washing appliance provided by the embodiments of the present disclosure.

In the drawings, 1, outer barrel; 101, outer barrel bottom; 2, locking structure; 201, locking motor; 202, bolt; 3, drum motor; 301, rotor; 302, locking groove; 4, position detection device; 401, permanent magnet; and 402, Hall sensor.

It should be noted that these drawings and written description are not intended to limit the scope of the present disclosure in any way, but rather to illustrate the concept of the present disclosure by reference to specific embodiments for those skilled in the art.

DETAILED DESCRIPTION

In order to make the purpose, the technical solution and the advantages of embodiments of the present invention clearer, the technical solutions in the embodiments are clearly and completely described in combination with accompanying drawings in the embodiments of the present invention. The following embodiments are used for illustrating the embodiments of the present invention, but are not used for limiting the scope of the embodiments of the present invention.

In the description of the present invention, the orientation or position relation indicated by terms "upper", "lower", "inner", "outer" and the like is based on the orientation or position relation shown in the accompanying drawings, and is only used for conveniently describing the present invention and simplifying the description, instead of indicating or implying that the indicated device or element has a specific orientation and is constructed and operated in the specific orientation, so that the terms cannot be understood as the limitation on the present invention.

In the description of the present invention, it should be noted that the terms "installation" and "connection" should be interpreted in a broad sense unless otherwise clearly defined and restricted. For example, the connection may be a fixed connection, a detachable connection, or an integrated connection; may be a mechanical connection or an electric connection; and may be a direct connection, and an indirect connection through an intermediate medium. For those of ordinary skill in the art, the specific meanings of the above terms in the present invention can be understood in specific situations.

As shown in FIG. 1, according to one aspect of the present disclosure, a determination method for locking a drum of washing appliance which is provided with a drum motor 3 for driving a drum to rotate, and a locking structure 2, comprises driving the drum to rotate at a set power output of the drum motor 3, the locking structure 2 generating a locking action for locking the drum, and being determined that the drum is locked by the locking structure 2 when a output current of the drum motor 3 is larger than a rated current.

In the embodiments of the present disclosure, in the above technical solution, the locking structure 2 on the washing appliance is used for locking the drum at a locking position, the drum motor 3 drives the drum to rotate at the set power output, the locking structure 2 takes the locking action for locking the drum, the drum continues to rotate, and it is determined that the drum is locked by the locking structure 2 when the output current of the drum motor 3 is larger than the rated current. It is can be accurately judged whether the drum is locked by the locking structure 2 through the determination method, and therefore the drum locking accuracy can be improved.

It should be noted that in the above solution, the locking structure 2 locks the drum at the locking position of the drum. The locking position of the drum refers to a position when the drum door is in a normal opening position. The drum is locked at the locking position by the locking structure 2, namely the drum door is locked at the normal opening position of the drum door by the locking structure 2.

As shown in FIG. 1, in the embodiments of the present disclosure, the locking structure 2 takes a locking action for locking the drum, the drum motor 3 drives the drum to continuously rotate at a set power output, and an output current of the drum motor is detected to obtain the output current $I_1$ of the drum motor after the drum rotates for a certain time t.

If $I_1>I_0$, the locking structure 2 locks the drum; and if $I_1<I_0$, the locking structure 2 does not lock the drum.

In the embodiments of the present disclosure, it is provided how to determine whether the drum is locked at the locking position. In the above technical solution, after the locking structure 2 takes the locking action for locking the drum, the drum motor 3 drives the drum to continuously rotate at the set power output. The output current of the drum motor 3 is detected after the drum rotates for a certain time t. If the output current of the drum motor is larger than the rated current, it is indicated that the locking structure 2 locks the drum. If the output current of the drum motor 3 is smaller than the rated current of the drum motor, it is indicated that the locking structure 2 fails to lock the drum. Through the comparison, it can be accurately determined that the drum is locked, and the drum locking accuracy is improved.

In the embodiments of the present disclosure, the locking structure 2 includes a bolt 202 and a locking motor 201 for driving the bolt 202 to stretch out and draw back in a radial direction, and a rotor 301 of the drum motor 3 is provided with a locking groove 302.

After the drum rotates for a certain time t, the bolt 202 of the locking structure 2 is aligned with the locking groove, the locking motor 201 drives the bolt 202 to be inserted into the locking groove 302, and the drum is locked by the locking structure 2.

Preferably, after the bolt 202 is inserted into the locking groove 302 to lock the drum, the drum motor 3 is powered off to stop working.

In the embodiments of the present disclosure, after the drum rotates for a certain time, the bolt 202 of the locking structure 2 is aligned with a groove opening of the locking groove 302, the locking motor 201 drives the bolt 202 to be inserted into the locking groove 302, so the drum is locked by the locking structure 2. After the bolt 202 is inserted into the locking groove 302 to lock the drum, the drum motor 3 is powered off to stop working, and thus, locking of the drum in a position is completed;

It should be noted that within a certain time t when the drum rotates, the locking motor 201 can drive the bolt 202 to abut against the locking motor 201, and is slightly positioned. Along with rotation of the drum, when the bolt 202 of the locking structure 2 is right aligned with the groove opening of the locking groove 302 in rotation of drum, the locking motor 201 can drive the bolt 202 to be accurately inserted into the locking groove 302.

In the embodiments of the present disclosure, after the locking structure 2 fails to lock the drum, the locking motor 201 drives the bolt 202 to be detached from the drum motor 3, and the bolt 202 is reset. The drum motor 3 drives the drum to continuously rotate at a set power output, and whether the drum is locked by the locking structure 2 is determined again.

In the embodiments of the present disclosure, after the locking structure 2 fails to lock the drum, it is determined again whether the drum is locked by the locking structure 2 until the drum is locked by the locking structure 2. In order to determine whether the drum is locked by the locking structure 2 again, in the process, the locking motor 201 drives the bolt 202 to be detached from the drum and the bolt 202 is restored to the original position, and the drum motor 3 drives the drum to continuously rotate at a set power output. The output current of the drum motor 3 is detected again, and the probability that the locking structure 2 locks the drum successfully is increased.

As shown in FIG. 1, in the embodiments of the present disclosure, S1, the drum motor 3 drives the drum to rotate at a set power output, the locking structure 2 takes a locking action for locking the drum, the drum motor 3 drives the drum to continuously rotate at the set power output, and an output current of the drum motor 3 is detected to obtain an output current value $I_1$ of the drum motor 3 after the drum rotates for a certain time t;

S2, the output current value $I_1$ of the drum motor 3 is compared with a rated current value, and if $I_1>I_0$, a step S3 is executed; and if $I_1<I_0$, a step S5 is executed;

S3, if it is determined that the locking motor 201 drives the bolt 202 to be inserted into the locking groove 302, the drum is locked by the locking structure 2, a step S4 is executed;

S4, the drum motor 3 is powered off to stop working; and

S5, the locking motor 201 drives the bolt 202 to be detached from the drum motor 3, the bolt 202 is reset, and the drum motor 3 drives the drum to continuously rotate at the set power output, a step S1 is executed again.

In the embodiments of the present disclosure, the washing appliance further includes a position detection device 4, and the position detection device 4 includes a Hall sensor 402 arranged on the outer barrel 1 and a permanent magnet arranged on a rotor 301 of the drum motor 3.

The drum motor 3 drives the drum to rotate at the set power output. The permanent magnet 401 on the rotor 301 of the drum motor 3 is detected through the Hall sensor 402 so as to detect whether the locking groove of the rotor is reached on a position. If the groove of the rotor is reached on a position, the locking structure 2 is prompted to take a locking action for locking the drum.

In the embodiments of the present disclosure, the permanent magnet is arranged on the rotor 301 of the drum motor 3. When the permanent magnet on the rotor 301 of the drum motor 3 is detected by the Hall sensor 402, the locking structure 2 starts to take a locking action for locking the drum, so that the bolt 202 of the locking motor 201 can be accurately inserted into the locking groove 302, and the accuracy of locking the drum is improved.

In the embodiments of the present disclosure, after the drum motor 3 receives a stop command, a power of the drum motor is reduced to a set power, and the drum motor 3 drives the drum to rotate at the set power output.

In the embodiments of the present disclosure, if the drum motor 3 is suddenly braked when the power of the drum motor and the rotating speed of the drum are relatively high, the impact force on the bolt 202 of the locking structure 2 is large, so the bolt can be cut off by the instant impact force, and the washing appliance is broken down. Thereby the power of the drum motor 3 needs to be reduced to the set power in order to avoid the above situation to be happened.

It should be noted that the drum motor 3 and the locking motor 201 are both controlled by a controller. The controller controls the drum motor 3 to start rotating, reduce a rotating speed, stop rotating and the like, and the controller controls the locking motor 201 to run and controls the locking motor 201 to drive the bolt 202 to draw back.

In the embodiments of the present disclosure, after the locking structure 2 fails to lock the drum and if it is detected that the number of times that the locking structure 2 fails to lock the drum exceeds the set number of times, the locking structure 2 stops locking, and the washing appliance sends out an alarm signal.

In the embodiments of the present disclosure, after it is detected that the locking structure 2 fails to lock the drum for multiple times and the number of times of failure exceeds the number of times set by a system, the locking structure 2 is controlled to stop locking. The washing appliance gives an alarm to warn that the washing appliance is broken down, and the error rate of locking the drum is reduced.

Another object of the present disclosure is to provide washing appliance for improving the accuracy of locking the drum. The washing appliance includes a drum for containing washing water and a drum motor for driving the drum to rotate. The washing appliance is applied to the determination method for locking of the drum of the washing appliance in the above technical solution, and the washing appliance is provided with a locking structure 2 for locking the drum at a locking position.

In the embodiments of the present disclosure, the locking structure 2 arranged on the washing appliance can lock the drum for containing the washing water at the locking position, so that the drum door is locked at the normal opening position. The accuracy of locking the drum by the locking structure 2 is improved by determining whether the locking structure 2 successfully locks the drum at the locking position.

In the embodiments of the present disclosure, the drum is a closed container for containing washing water when the washing appliance executes a washing program.

In the embodiments of the present disclosure, the washing appliance includes an inner drum and an outer barrel 1, wherein the drum is used for containing washing water.

In the embodiments of the present disclosure, a lifting rib is arranged on the side wall of the inner drum, and a containing cavity is formed in the lifting rib. A first through hole communicating with the inner space of the inner drum and a second through hole communicating with a gap between the inner drum and the outer barrel are formed in the wall of the containing cavity, and a control structure for controlling the first through hole and/or the second through hole to be opened and closed is arranged in the containing cavity. Through the arrangement, liquid in the inner drum is discharged when the inner drum is a hole-free inner drum. When the first through hole and/or the second through hole are/is closed, the interior of the inner drum is in a closed state, so that washing water in the inner drum is prevented from splashing to the inner wall of the outer barrel 1. When the first through hole and the second through hole are opened, the interior of the inner drum is in an open state, and washing water in the inner barrel is discharged into the gap between the inner drum and the outer barrel.

Figure 2:
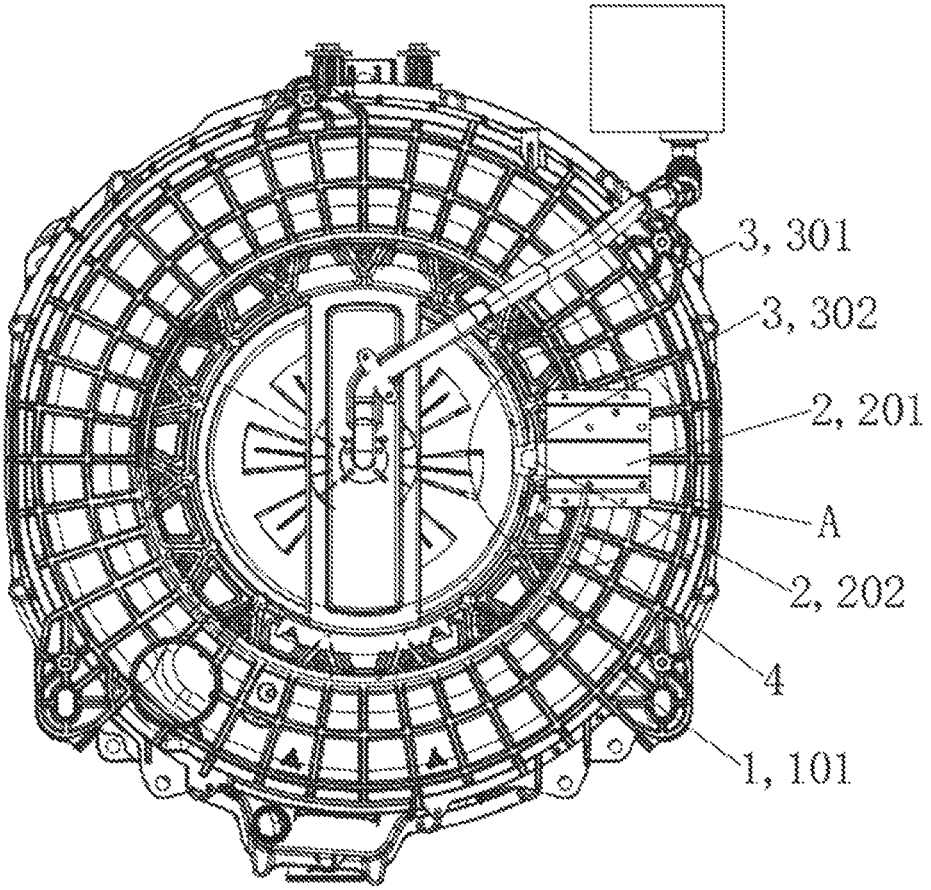
FIG. 2 is a structural schematic diagram of washing appliance provided by the embodiments of the present disclosure.
Figure 3:
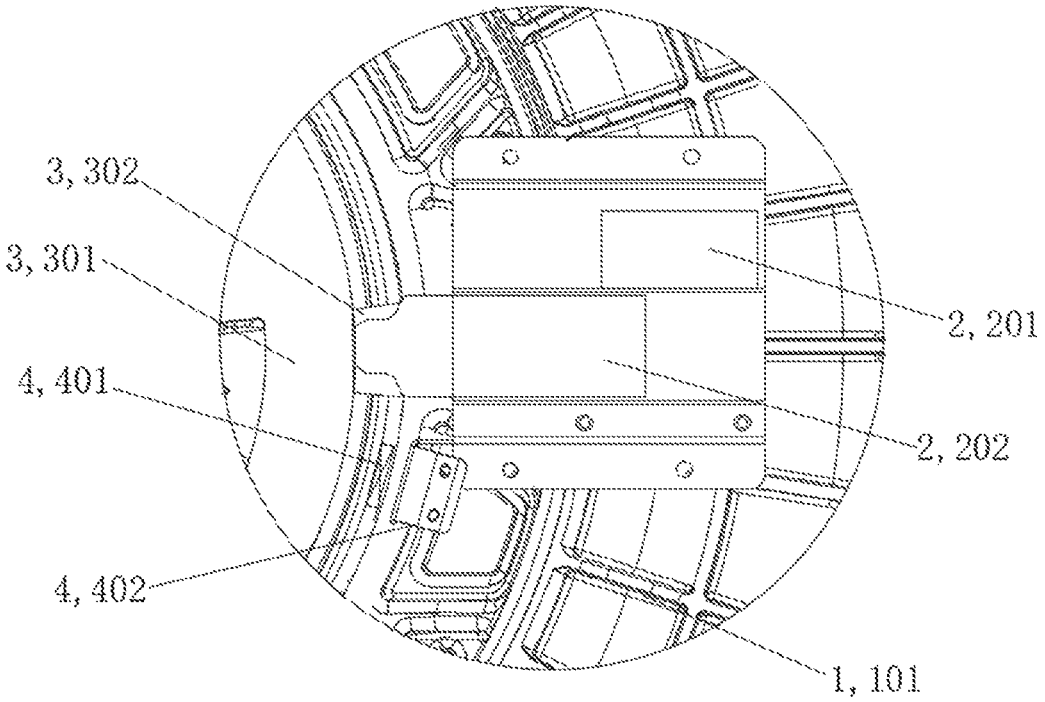
FIG. 3 is an enlarged view of FIG. 2 at the A position.

As shown in FIG. 2 and FIG. 3, in the embodiments of the present disclosure, the inner drum is rotatably mounted in the outer barrel 1 of the washing appliance, and the locking structure 2 is mounted on an outer barrel bottom 101.

In the embodiments of the present disclosure, the drum is rotatably mounted in the outer barrel 1 of the washing appliance as an inner drum. When the inner drum rotates to a locking position, a locking structure 2 mounted on the outer barrel 1 locks the inner drum at the locking position, and the inner drum is locked to stop rotating, and a drum door of the inner drum is locked at a normal opening position.

As shown in FIG. 2 and FIG. 3, in the embodiments of the present disclosure, the locking structure 2 includes a bolt 202 and a locking motor 201 for driving the bolt 202 to stretch out and draw back in a radial direction. A rotor of the drum motor 3 is provided with a locking groove 302 matched with the bolt 202, and the bolt 202 is driven to be inserted into or detached from the locking groove 302 by the locking motor 201.

In the embodiments of the present disclosure, after the drum rotates for a certain time t, the bolt 202 of the locking structure 2 is aligned with the locking groove 302, the locking motor 201 drives the bolt 202 to be inserted into the locking groove 302, and the drum is locked at a locking position by the locking structure 2. After the bolt 202 is inserted into the locking groove 302 to lock the drum, the drum motor 3 is powered off to stop working.

It should be noted that the bolt of the locking structure can be a motor shaft of the locking motor 201.

In another embodiment of the present disclosure, the washing appliance includes a drum for containing washing water and the locking structure 2 being configured to be mounted on a shell of the washing appliance. The locking structure 2 includes a bolt 202 and a locking motor 201 for driving the bolt 202 to stretch out and draw back in a radial direction. A rotor of the drum motor 3 is provided with a locking groove 302 matched with the bolt, and the bolt is driven to be inserted into or detached from the locking groove 302 by the locking motor 201.

In another embodiment of the present disclosure, the washing appliance includes a drum and an outer barrel, and the outer barrel is used for containing washing water. The locking structure 2 can be mounted on the outer barrel of the washing appliance. A rotor of the drum motor 3 is provided with a locking groove matched with the bolt 202, and the bolt 202 is driven to be inserted into or detached from the locking groove by the locking motor 201.

As shown in FIG. 2, in the embodiments of the present disclosure, a position detection device 4 used for detecting the position of the rotor 301 of the drum motor 3 is further included. A first part of the position detection device 4 is arranged on the rotor 301 of the drum motor 3, a second part of the position detection device 4 is arranged on the outer barrel, and the first part of the position detection device 4 interacts with the second part of the position detection device 4 to generate corresponding position information during working.

In the embodiments of the present disclosure, it should be noted that the position of the other part of the position detection device 4 is arranged corresponding to the locking position of the drum. The position detection device 4 can be composed of a mechanical element, an electronic element, an electromagnetic element or other element or a complex thereof. The first part of the position detection device 4 rotates along with the rotor 301 of the drum motor 3. Along with continuous rotation of the first part of the position detection device 4, the first part of the position detection device 4 rotates to the position where the second part of the position detection device 4 is located and interacts with the second part of the position detection device 4 to generate corresponding position information, so that whether the locking groove in the rotor is reached a position is detected. If yes, the locking structure 2 generates a locking action for locking the drum.

As shown in FIG. 2 and FIG. 3, in the embodiments of the present disclosure, the position detection device 4 includes a permanent magnet 401 and a Hall sensor 402.

The permanent magnet 401 is arranged on the rotor 301 of the drum motor 3, and the Hall sensor 402 is arranged on the outer barrel 1. The Hall sensor 402 and the permanent magnet 401 interact with each other to generate corresponding position information when working.

In the embodiments of the present disclosure, the Hall sensor 402 is arranged at the position, corresponding to the bolt, of the outer barrel 1, and the permanent magnet is arranged at the position, corresponding to the locking groove 302, of the drum motor 3. When the Hall sensor 402 detects a permanent magnet signal, the locking structure takes a locking action for locking the drum, and the drum motor 3 drives the drum to continuously rotate at the set power output. After the drum rotates for a certain time t, the drum rotates to the position where a groove opening of the locking groove 302 is aligned with the bolt of the locking structure, the drum rotates to the locking position, the drum door reaches the normal opening position, the locking motor 201 drives the bolt to be inserted into the locking groove 302, and the drum is locked at the locking position.

In addition, the permanent magnet is arranged on the outer barrel 1, the Hall sensor is arranged on the rotor 301 of the drum motor 3, and the Hall sensor rotates along with the rotor 301 of the drum motor 3.

In the embodiments of the present disclosure, the position detection device 4 includes a photoelectric sensor and a luminous body.

The photoelectric sensor is arranged on the rotor 301 of the drum motor 3, and the luminous body is arranged on the outer barrel 1; and the photoelectric sensor and the luminous body interact with each other to generate corresponding position information during working.

In the embodiments of the present disclosure, the luminous body is arranged at the position, corresponding to the bolt 202, of the outer barrel 1, and the photoelectric sensor is arranged at the position, corresponding to the locking groove 302, of the drum. When the photoelectric sensor detects an optical signal of the luminous body, the locking structure takes a locking action for locking the drum, and the drum motor drives the drum to continuously rotate at the set power output. After the drum rotates for a certain time t, the drum rotates to the position where the locking groove 302 is aligned with the bolt 202 of the locking structure 2, the drum door reaches the normal opening position, the locking motor 201 releases the bolt 202 to stretch out and be inserted into the locking groove 302, and the drum is locked at the locking position.

In addition, the photoelectric sensor is arranged on the outer barrel 1, the luminous body is arranged on the rotor 301 of the drum motor 3, and the photoelectric sensor rotates along with the luminous body.

The above descriptions are only preferred embodiments of the present invention, but are not aimed at limiting the present invention in any forms. Although the present invention is disclosed above by the preferred embodiments, the preferred embodiments are not aimed at limiting the present invention. Those skilled in the art can make some changes by using the above suggestive technical contents or modify the technical contents as equivalent embodiments of equivalent changes without departing from the scope of the technical solution of the present invention. Any simple alterations, equivalent changes and modifications that are made to the above embodiments according to the technical essence of the present invention without departing from the contents of the technical solution of the present invention should all fall within the scope of the solution of the present invention.

The invention claimed is:

1. A determination method for locking of a drum of a washing appliance, wherein the washing appliance comprising a drum motor for driving the drum to rotate and a locking structure, the determination method comprising:

driving the drum to rotate at a set power output by the drum motor;

locking the drum by the locking structure;

wherein the drum motor drives the drum to continuously rotate at the set power output;

determining whether or not the drum is locked by the locking structure by comparing a rated current $I_0$ of the drum motor with an output current $I_1$ of the drum motor after the drum has been driven to rotate for a time t;

wherein the drum is determined to be locked by the locking structure when $I_1>I_0$; and wherein the locking structure is determined to have failed to lock the drum when $I_1<I_0$.

2. The determination method for locking of the drum of the washing appliance according to claim 1, wherein the locking structure comprises a bolt, and a locking motor for driving the bolt to stretch out and draw back in a radial direction, and a rotor of the drum motor is provided with a locking groove;

wherein after the drum rotates for the time t, the bolt of the locking structure is aligned with the locking groove, the locking motor drives the bolt to be inserted into the locking groove, and the drum is locked by the locking structure.

3. The determination method for locking of the drum of the washing appliance according to claim 2, wherein after determining that the locking structure has failed to lock the drum, the locking motor drives the bolt to be detached from the drum motor, the bolt is reset, the drum motor drives the drum to continuously rotate at the set power output, and it is determined again whether or not the drum is locked by the locking structure.

4. The determination method for locking of the drum of the washing appliance according to claim 3, comprising:

S1, driving the drum to rotate by the drum motor at the set power output, locking the drum by the locking structure, driving the drum to continuously rotate by the drum motor at the set power output;

S2, comparing the output current value $I_1$ of the drum motor after rotating for the time t with the rated current $I_0$, and if $I_1>I_0$, executing step S3; and if $I_1<I_0$, executing step S5;

S3, if it is determined that the locking motor drives the bolt to be inserted into the locking groove and the drum is locked by the locking structure, executing step S4;

S4, powering off the drum motor to stop working; and

S5, driving the bolt to be detached from the drum motor by the locking motor, resetting the bolt, and driving the drum to continuously rotate at the set power output by the drum motor, and executing the step S1 again.

5. The determination method for locking of the drum of the washing appliance according to claim 2, wherein, after the bolt is inserted into the locking groove to lock the drum, the drum motor is powered off to stop working.

6. The determination method for locking of the drum of the washing appliance according to claim 1, wherein the drum motor receives a stop command, a power of the drum motor is reduced to a set power, and the drum motor drives the drum to rotate at the set power output.

7. The determination method for locking of the drum of the washing appliance according to claim 1, wherein if it is detected that the locking structure has failed to lock the drum more than a pre-set number of times, then the locking structure stops locking, and the washing appliance sends out an alarm signal.

8. A washing appliance, comprising:

a drum for containing washing water;

a drum motor for driving the drum to rotate; and a locking structure for locking the drum;

wherein a determination method for locking of the drum of the washing appliance comprises:

driving the drum to continuously rotate at a set power output by the drum motor;

locking the drum by the locking structure;

determining whether or not the drum is locked by the locking structure by comparing a rated current $I_0$ of the drum motor with an output current $I_1$ of the drum motor after the drum has rotated for a time t;

wherein the drum is determined to be locked by the locking structure when $I_1>I_0$; and wherein the locking structure is determined to have failed to lock the drum when $I_1<I_0$.

9. The washing appliance according to claim 8, wherein the drum is a closed container for containing washing water when the washing appliance executes a washing program.

10. The washing appliance according to claim 8, wherein the drum is rotatably mounted in an outer barrel of the washing appliance, and the locking structure is mounted on the outer barrel; wherein the locking structure comprises a bolt, and a locking motor for driving the bolt to stretch out and draw back in a radial direction, wherein a rotor of the drum motor is provided with a locking groove matched with the bolt, and wherein the bolt is inserted into or detached from the locking groove under the drive of the locking motor.

* * * * *